United States Patent [19]

Young

[11] Patent Number: 4,904,018

[45] Date of Patent: Feb. 27, 1990

[54] ALL-TERRAIN FOLDABLE SEAT

[76] Inventor: Noah W. Young, R.R. 2, Box 823, Monrovia, Ind. 46157

[21] Appl. No.: 260,123

[22] Filed: Oct. 20, 1988

[51] Int. Cl.[4] ..... A47C 9/10

[52] U.S. Cl. ..... 297/4; 297/55; 297/345; 108/116; 108/128

[58] Field of Search ..... 297/4, 345, 310, 55, 297/56; 108/115, 116, 128

[56] References Cited

U.S. PATENT DOCUMENTS

| | | | |
|---|---|---|---|
| 405,117 | 6/1889 | Purdy et al. | 108/128 |
| 979,959 | 12/1910 | Johnson | 297/56 |
| 1,876,479 | 9/1932 | Weller | 297/55 |
| 2,567,595 | 9/1951 | Bryant | 108/116 |
| 3,713,568 | 1/1973 | Sloan | 297/4 |
| 3,895,839 | 7/1975 | Amato | 297/4 |
| 4,044,931 | 8/1977 | Catelli | 297/55 |
| 4,148,523 | 4/1979 | Brand et al. | 297/345 |

*Primary Examiner*—Francis K. Zugel
*Attorney, Agent, or Firm*—Robert A. Spray

[57] ABSTRACT

A foldable seat device having diagonal side legs for support of a flexible sheet seat along its rearward and forward portions; and although legs extending from the rearward portion of the seat are conventionally continuous to their feet, the legs extending from the forward portion of the seat are of two discrete and non-connected portions.

Of those legs, the adjacent ends of the lower rearward leg portion, and of the upper forward leg portion, are pivotally connected to the other legs at spaced points therealong; and those unconnected leg portions are pivotally movable independently of one another, permitting a seat-open condition of the seat even though the rear seat-feet may be then retracted to permit a support of the seat in a partially folded condition which permits a use of the seat while the device is leaning against a tree for user comfort.

The pivotal connection involving of the lower rearward leg portions are movable along the legs extending from the rear of the seat, achieving, by an in-effect change of rear leg length, the advantage of optional seat-tilt change, for accommodation of variations of slope of the supporting ground, without a change of actual leg-length.

A hook member permits convenient carry on the user's belt.

15 Claims, 1 Drawing Sheet

ALL-TERRAIN FOLDABLE SEAT

FIELD OF THE INVENTION

The present invention relates to folding chairs; and more particularly in the embodiment herein illustratively set forth, the invention and its concepts relate to small folding stools commonly referred to as a "stool" or a "camp stool" having a flexible seat of sheet material which is folded generally flat in a collapse-folded condition of the stool, and becomes unfolded to a seat-forming condition when the stool's leg-structure is unfolded from a collapse-folded travelling and/or storage condition.

Folding chairs of various types have been available and sold, no doubt by the millions, for many years; and the fold-out camp stools mentioned above have been purchased and/or used and/or at least seen, with obvious and easily apparent foldability nature, that further background as to folding chair and camp stools in particular as to their widespread use, desirability, and convenience, seems unnecessary.

Their widespread use, and many years of use, also makes unnecessary any lengthy recital of their disadvantages; for, except for use for relatively short periods, and for use upon a surface which is quite flat and quite horizontal, the uncomfortableness of camp stools becomes very apparent, because of their failure to provide or accommodate back-support, and because of their uncomfortableness on sloping ground.

And the realistic enigma of the use of camp stools, unfortunately, is that many of the very occasions for desired use of camp stools are the very occasions, usually outdoor occasions, in which the chosen ground spot for placement of the stool is neither flat nor level, and the occasion is for at least several minutes of tiresome and uncomfortable seating with no back support, all especially tiresome and bothersome because the overall happening is often one that has required much walking and/or other tiresome or unusual activity for the user.

The importance of such camp stools to millions of households is emphasized by their long and widespread popularity in spite of such disadvantages as mentioned above; for even though such disadvantages may often lessen the user's enjoyment of the happening, which often is one of hopeful enjoyment of leisure or recreational nature, the convenience of such camp stools and the partial comfort they do provide makes for an acceptability as being better than no seat at all.

Thus, millions of users patiently endure the discomfort of such stools; and indeed the very simplicity of such stools has probably led to the belief that they are too simple to be adapted to accommodate sloping ground or back support.

Yet those advantages are what are provided and achieved by the present invention, without significantly adding to the skeletal-type simplicity of structure, nor significantly adding complexity to the features of convenience of folding or unfolding, all this by features of convenient manipulatability and economy of construction.

SUMMARY OF THE INVENTION

In carrying out the invention, its concepts and features provide an advantageous and multi-use foldable seat device similar in basic format to a so-called "camp stool" having diagonal side legs for support of a flexible sheet seat. The side legs, as they extend forwardly and downwardly from the rearward position of the seat, are conventionally continuous to their feet; however, the legs extending rearwardly and downwardly from the forward portion of the seat are of two discrete and non-connected portions. Further, the lower rear one of those two leg-portions is slidably fixed to various portions of the continuous legs, optionally achieving, by an in-effect change of rear leg length, the advantage of optional seat-tilt change, for accommodation of variations of slope of the supporting ground, without a change of actual leg-length.

Further variation of mode of use is provided by the type of independent connection of those leg-portions to the continuous legs. That is, the adjacent ends of the lower rearward leg portion, and of the upper forward leg portion, are separately as well as pivotally connected to the continuous legs at spaced points therealong; and pivotal independence of one another of those leg portions permits a seat-open condition of the seat even though the rear leg portions may be then retracted to permit a support of the seat in a partially folded condition which permits a use of the seat while the device is leaning against a tree, for user comfort.

A hook member permits convenient carry on the user's belt.

The invention's components and concepts are similar to those available in the prior art, except for the present concepts in particular:

In a hindsight consideration of the present invention to determine its inventive and novel nature, it is not only conceded but emphasized that the prior art had details usable in this invention but only if the prior art has had the guidance of the present concepts of the present invention; and the prior art had much motivation for the present invention.

That is, it is emphasized that the prior art had several particulars of prior art and motivation which individually and accumulatively show the non-obviousness of this combination invention as to its various features.

a. Chairs are devices which probably are of the most ancient use and knowledge, even of pre-historical nature; and chairs, as devices, are universally known and have been used daily by all the billions of human beings of all time, the world over.

b. Foldable chairs of various types, have been known and used by probably all persons of modern times.

c. Foldable chairs are devices as to which most all persons have intellectually considered their mechanical details; for the manual techniques required in using foldable chairs in their expressly-intended manner uniquely require such a consideration, more so probably than in use of most other devices, for as to other devices, their mechanical operativity details can be utilized without such consideration, whereas as to foldable chairs each user has to consider their operativity in order to achieve their fold-up and/or unfolding effect.

d. Most persons have used the very type of small foldable chairs, i.e., so-called "camp stools" of a scissors-leg or "pivotal-X-frame" type which are probably the closest prior art to the present invention.

e. The mechanism of such camp stools is readily and openly apparent; and similarly apparent is the supposed futility as to changing the actual length of camp stool legs as probably seems the only way to adjust seat tilt in such devices for accommodation of ground-slope variations.

f. The prior art knew that probably most persons the entire world were sufficiently knowledgeable as to such low-cost camp stools that it would seem likely that there would be a likely unlimited market, coupled with an acceptability for improved camp stools, without a sales resistance built on a hate to have to discard an expensive possession, or seem to have to duplicate an expensive earlier purchase.

g. Most persons who have used such camp stools have been often annoyed by their lack of comfortable accommodations of non-horizontal supporting surfaces, even though quite a variation of such non-horizontal nature of the support is a very common occurrence when using a camp stool, such as at various outdoor activities, such as outdoor concerts, golf tournaments, hunter's rest spots, etc.

h. The realized non-accommodatability of such camp stools to an actual change of leg-length probably has discouraged all others from considering other in-effect, rather than actual, leg-length changes.

i. Most persons who have used such camp stools have been often annoyed by their lack of comfortable accommodations of a "lean-back" use by which the user can lean back against a tree or supporting wall.

j. The realized automaticness of full spread of all forelegs and rear legs of a camp stool, whenever unfolded to seat-open position, has no doubt made it appear to most users that the rear legs would inevitably preclude a lean-against-a-tree use, even though such a use would be very desired for comfortable backrest, etc. And if the conventional camp stools cannot be leaned back, hindsight suggests that the problem resided in that very automaticness of spread of all four legs when the conventional X-frame camp stool was unfolded for seating, and further hindsight would then suggest that a way was needed to avoid such four-leg automaticness; and then a third-stage of hindsight might urge an extra pivot for only the rear legs. But hindsight is not a legitimate tool of analysis.

k. Most persons who have used such camp stools have been often annoyed by their lack of comfortable accommodations of being conveniently carried, especially since the type of activity in which a camp stool is used is often the very type of activity involving lengthy walking and also involving the manual carry of other objects.

l. Although the conceptual adaptations of camp stools to provide the special features of the present invention are not at all apparent, and for scores of years have not been at all apparent, the mechanical adaptations to achieve such physical adaptations have always been within the skill and mechanical ability of most persons.

m. Leg-length changing, to accommodate non-evenness of the supporting floor or ground, has been provided by such things as screw-type adjustment feet for furniture, extenders for a ladder-leg, etc.; and even effective leg-length change has been provided by use of shims.

n. The prior art well knew pivotal connections, support brackets, movable connections, detent-held variability of the relative position of relatively movable parts including telescoping and other slidable parts, limiting-lug abutments, and all the other mechanical features of this invention, as considered as abstract features rather than conceptually in this combination.

o. Further non-obviousness of the invention is shown by the very apparent presence of the vertically-extending legs coming down from the rear of the seat, whose vertical extent already has provided a vertical optionality of attachment of the chair's rear legs which can and here does provide an in-effect leg-length change; yet such a glaringly apparent component, already and inherently present, and always strong enough to suitably serve as an adjustable support base, has never provided a suggestion for the present invention.

With the reality of all these factors, the inventive non-obviousness of the present invention, as seen in its various combinations, is quite manifest.

The Prior Art has attempted various type of foldable chairs and stools, but not having the advantageous features of this invention:

The prior art has tried a variety of types of foldable chairs and stools having provisions for stackability, nestability, ease of folding and unfolding, comfort, even floatability, etc.; and built-in and added-on shims, extenders, etc., have been provided for accommodation of uneven or sloping ground or floors. And the existence of such articles embodying such various features is not only conceded, it is emphasized; for as to the novelty here of the combination, of the invention as considered as a whole, a contrast to the prior art helps show both the great variety and the dissatisfaction of the various prior art attempts of improvement, and the advantages and the inventive significance of the present concepts. Thus, as shown herein as a contrast to all the prior art, the inventive significance of the present concepts as a combination is emphasized, and the nature of the concepts and their results can perhaps be easier understood.

The advantageous nature of the present invention is especially illustrated by contrasting it with the references found in a prior art Search in the U.S. Patent Office after this invention was made and during consideration of the patenting efforts. The Search showed the following, all U.S. Patents:

| | | |
|---|---|---|
| Rosen | 2,982,455 | 1961 |
| Bedsaul | 3,285,482 | 1966 |
| Black | 3,315,856 | 1967 |
| Fernandez | 4,387,924 | 1983 |

Rosen shows a typical scissors-type or X-type support leg structure with a fold-out seat; but there is no leg-extension feature, and no swingability of a rear leg to accommodate a lean-back use while the seat is in seat-forming position;

Bedsaul shows a belt-carrier bracket, but no seat or legs;

Black shows a combination seat and pack sack or packboard, but no leg-extendability; and not being of scissors or X-frame type, shows no suggestion of a a lean-back use in which the front legs support both the seat-rear and seat-front in seat-forming rondition; and Ferndandez shows another combination seat and back pack, and is of a scissors or X-frame type of leg structure with a fold-out seat; but there is no leg-extension feature, and no swingability of a rear leg to accommodate a lean back use while the seat is in seat-forming position.

Although varieties of prior art are conceded, and ample motivation is shown, and full capability in the prior art is conceded, no prior art shows or suggests details of the overall combinations of the present invention, as is the proper and accepted way of considering the inventiveness nature of the concepts.

That is, although the prior art shows an approach to the overall invention, of an inexpensive fold-up camp stool, and the prior art has shown tilt-adjustability by change of leg-length of furniture articles, etc., it is significant that none of the prior art shows the novel and advantageous combinations, which provide the merits of this invention, even though certain details are shown separately from this accomplishment.

Accordingly, the various concepts and components are conceded and emphasized to have been widely known in the prior art as to various furniture devices, even as to camp stools of scissors or X-frame type, and leg-change concepts and awareness of leg-length change significance; nevertheless, the prior art not having had the particular combinations of concepts and details as here presented and shown as novel combinations different from the prior art and its suggestions, even only a fair amount of realistic humility, to avoid consideration of this invention improperly by hindsight, requires the concepts and achievements here to be realistically viewed as a novel combinations, inventive in nature. And especially is this a realistic consideration when viewed from the position of a person of ordinary skill in this art at the time of this invention, and without trying to reconstruct this invention from the prior art without use of hindsight toward particulars not suggested by the prior art of all relevant fields.

BRIEF DESCRIPTION OF THE DRAWINGS

The above description of the novel and advantageous invention is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing the inventive concepts.

DETAILED DESCRIPTION OF ILLUSTRATIVE EMBODIMENT

Figure 1:
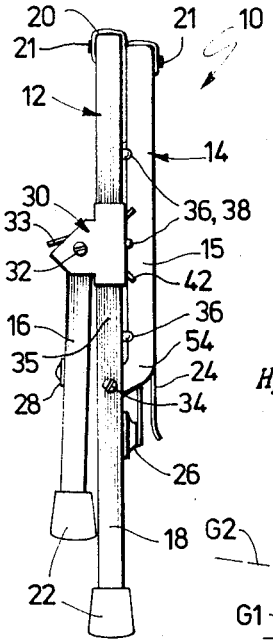
FIG. 1 is an elevation view of a camp stool of the present invention, in a collapsed or retracted condition of the legs and the seat sheet, as for carrying or storage.

As shown in the drawings, the novel seat device 10 has a first leg means 12, shown of a general U-shape, and a second leg means 14 also shown of a general U-shape except that at each side of the device it is not continuous but has two parts, i.e., an upper leg 15 and a lower leg 16.

Figure 2:
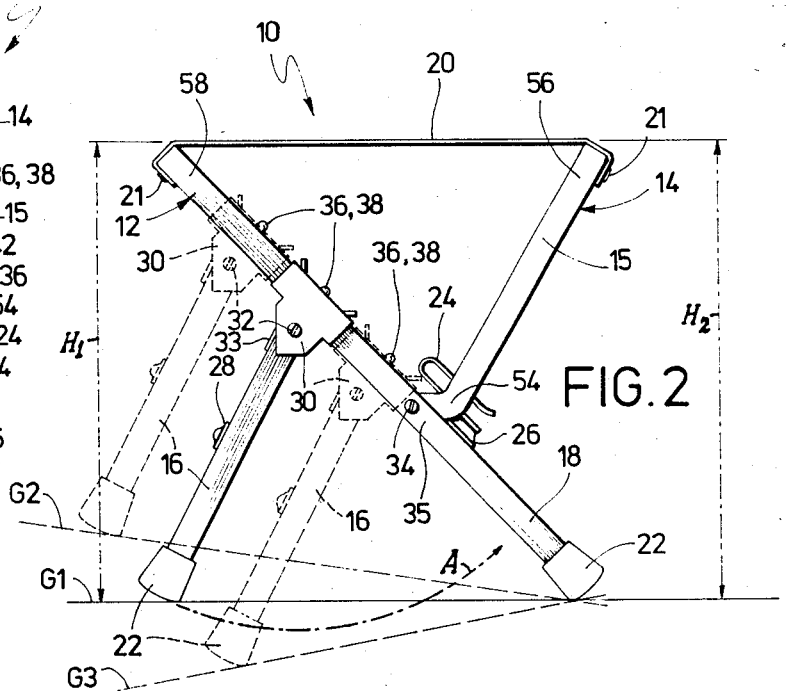
FIG. 2 is an elevation view of the stool, but in fully extended condition of both the seat sheet and its front seat-support leg, and of the rear leg which props the forward leg which both supports the rear of the seat sheet and the front seat-support leg; and, in this view, the movability of the rear leg for fixed optional location of its connection to that forward leg is indicated by dashed line showings of the rear leg, and the optionally-achieved seat-tilt for accommodation of non-level support ground is shown by dashed line showings of the ground-slopes ($G_2$ and $G_3$) and the effect of the change of position of the connection of the rear leg as to the distance ($H_1$) between the bottom of the rear leg and the rear of the seat-sheet, the height ($H_2$) of the front of the seat-sheet remaining the same.
Figure 3:
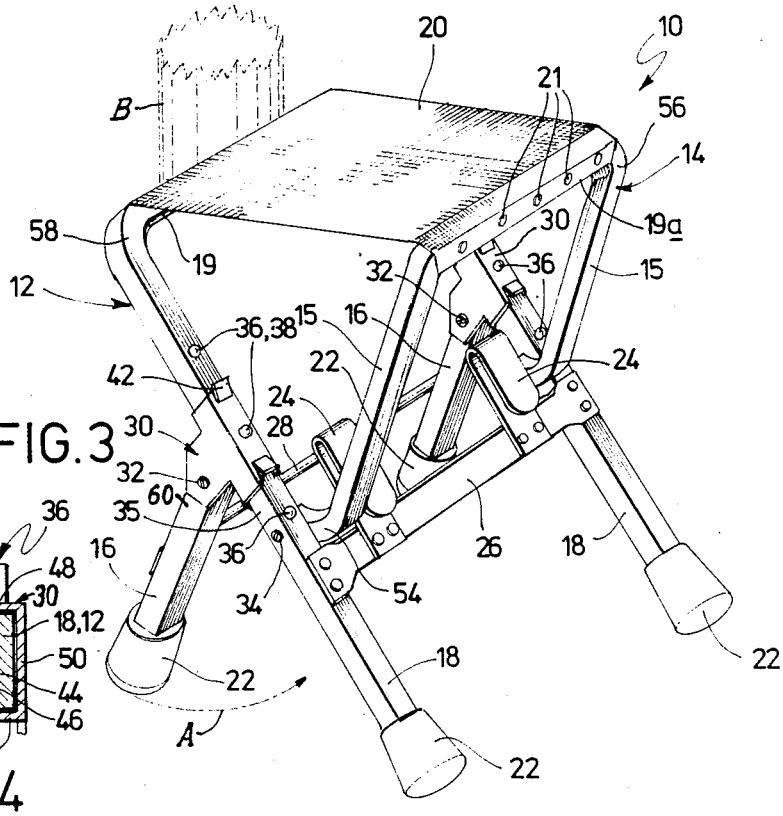
FIG. 3 is a pictorial view of the stool in the fully-extended condition of FIG. 2; and in chain lines, the lean-back mode of use is shown, i.e., by the swinging (indicator arrow "A") of the rear legs upward to permit use with the stool leaning back against a tree or other support "B" handy in the area of use of the stool.

Throughout, the parts are referred to as they appear in the device 10 as folded (or one might say "unfolded") into seat-forming condition, i.e., as in FIGS. 2 and 3 in contrast to the collapsed or carrying condition of FIG. 1; and thus the legs 18 of the first leg means 12 are noted as extending diagonally forwardly and downwardly from a rearward transverse upper support bar 19, and the leg sets 15 and 16 of the second leg means 14 generally diagonally (although not co-linearly) extend rearwardly and downwardly from a forward transverse upper bar 19*a*.

The legs 18 and the leg sets 15 and 16 are at each side of the device, and the seat 20 is a flexible sheet whose rearward and forward edges are suitably connected respectively, as by tacks 21, to the transverse bars 19 and 19*a;* and the lower ends of the legs 18 and 16 are shown provided with ground-engaging cup-like feet 22.

A pair of downwardly opening hook members 24 are shown provided on a transverse brace 26 extending between the legs 18 adjacent their lower ends, providing convenient carry of the device 10 on the user's belt; and a similar transverse brace 28 is shown extending between the legs 16.

A bracket 30 slidingly embraces each of the legs 18, and the bracket 30 has a pivot means such as a bolt 32 transversely extending from a position below and rearwardly of the respective leg 18, for pivotally carrying the lower leg 16; and the leg 16 is pivotal between a collapsed condition juxtaposedly adjacent the leg 18 (FIG. 1) and an extended or seat-propping condition as shown in FIGS. 2 and 3, its extended position being limited by a transverse abutment ear 33 on the support or carrying bracket 30.

Pivotally interconnected, by a transverse bolt or pin 34 at the lower end of upper legs 15 of leg set 14 and at a central portion 35 of the legs 18, the legs 15 and 18 are pivotally movable between a collapsed or juxtaposed condition of FIG. 1 and a seat-forming or extended condition of FIGS. 2 and 3, the amount of such extension or separateness being limited by the fore-and-aft dimension of the foldable seat sheet 20.

This relative movability of the supportive upper leg 15 of the second leg means 14 and the supportive lower leg 16 of the second leg means 14 advantageously provides and permits a use in which the supportive upper legs 15 are positioned outwardly (FIGS. 2 and 3) away from the first leg means 12, thus to support the forward portion of the seat 20 in seat-providing position with respect to the first leg means 12, even though the supportive rear legs 16 are positioned (FIG. 1, and swung forwardly, as shown by indicator-arrow "A", toward the leg-set 12) toward or in non-supportive position against the first leg means 12; and this provides a comfortable "lean back" use, i.e., with the seat 20 in a seat-forming condition, but, with the rear legs 16 in an out-of-the-way or non-propping condition, the upper rear transverse bar 19 may be propped against a tree or wall, providing a back-support mode of use. Such tree or wall is indicated at "B".

With further reference to the rear legs 16 and the advantageous carry of each leg 16 by a bracket 30, the bracket 30 is slidably movable with respect to the support legs 18 of the first leg means 12, advantgeously providing an option of where it is along each support leg 18 that is located the connection to each support leg 18 of the respective supportive rear or lower leg 16; and this provides a variation in "prop" seat-tilt by variation in the "in-effect" length of the rear legs 16, i.e., an optional variation in the comparative distance ($H_1$) between the lower end of the supportive lower leg 16 of the second leg means 14 to the rear transverse upper bar 19, and the distance ($H_2$) between the lower and of the support legs 18 of the first leg means 12 to the forward transverse upper bar 19*a*, without any actual change of length of the supportive rear or lower leg 16 of the second leg means 14.

Such change in seat-tilt for accommodation of variation in round-slope is indicated in FIG. 2, by the variations in placement of the bracket 30 illustrating accommodation of various ground slopes $G_1$, $G_2$, and $G_3$.

More particularly as to the movable connection means involving the bracket 30 and pivot 32, each leg 18 includes a plurality of detent means 36; and each of the detent means 36 includes an abutment lug or ball 38 carried by the first leg means 18, and opening means 40 in the bracket 30 for optionally receiving whichever one of the abutment lugs 38 is in registry with bracket opening 40 in the particular setting of the bracket 30.

As shown, the bracket 30 also carries an ear means42 which is inclined with respect to the first leg means 12, for pushing the abutment lugs or balls 38 to a retracted position of non-blocking as to the bracket 30, as the bracket 30 is being slid along the first leg means 18 in its movement to optionally engage the abutment lug 18 of a different detent means 36, to vary the seat-tilt.

Figure 4:
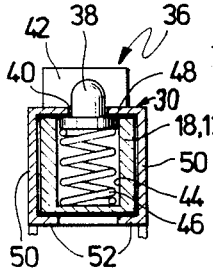
FIG. 4 is a cross-sectional detail, generally as taken transversely through one of the legs having the detents holding the carrier bracket of the connected leg.

This is accommodated (FIG. 4) by the ball 38 being carried in a leg-hole or recess 44 in the leg 18 (12); and of known type for such a detent 36, the hole 44 has a spring 46 which pushes the ball 38 up against an overlieing hole-edge 48 which retains the ball 38 but lets it extend into the bracket hole 40 for fixedly holding the position of the bracket 30 relative to the leg 18.

The bracket hole 40 is in the top wall 48 of the bracket 30, and the bracket 30's side walls 50 carry inturned bottom flanges 52; and, further as to the bracket 30 as shown, its top wall 48 is bent to provide one of the lug-releasing ears 42 at both ends, facing oppositely from one another.

As shown the detents 36 are located on the legs 18 all upwardly and rearwardly of the pivot 34, such that at all positions of the pivot 32 the pivot 32 is spaced upwardly and rearwardly of the pivot 34.

The lower end 54 of the upper support legs 15 is curved rearwardly adjacent its pivot 34; but the upper end 56 of those upper legs 15 is straight except for the integral turn into the transverse upper front bar 19*a*, as is the upper end 58 of legs 18 at the integral turn into the transverse rear upper bar 19. The upper end 60 of rear legs 16, adjacent the pivot connection 32, is straight, as are the bottom or foot portions of all legs at and adjacent their cup-like pads or feet 22.

CONCLUSION

It is thus seen that a camp stool on the like constructed and used according to the inventive concepts herein set forth, provides novel concepts of a desirable and advantageous device, yielding the advantages of an overall combination of a fold-out seat accommodating a variety of ground-slopes by change of effective although not actual leg-length, and separate pivotability as to seat-opening and seat-propping, and with accommodation for belt-carry of the device, which in overall combination is conceptually different from the prior art even though furniture and other objects embodying certain of the mechanical details as a basic capability has of course been known for years; yet significantly this particular combination of prior art has not been suggested by the prior art, this achievement being a substantial and advantageous departure from prior art, even though the prior art shows attempts at improvement and variations as to foldable chairs for many years. And particularly is the overall difference from the prior art significant when the non-obviousness is viewed by a consideration of the subject matter as a whole, as integrally incorporating a combination of features as different from the prior art, in contrast to merely those details of novelty themselves, and further in view of the prior art teaching away from the particular and inter-related concepts and features of the present invention.

In summary as to the nature of these advantageous concepts, their inventiveness is shown by novel features of concept and construction shown here, in novel and advantageous combination, not only being different from all the prior art known, but because the achievement is not what is or has been suggested to those of ordinary skill in the art, especially realistically considering this as comprising components which individually are similar in nature to what is well known to most persons, surely including most of the entire population for many years, the entire world over. No prior art has suggested the modifications of any prior art to achieve the novel concepts here achieved, with the various features providing their own functions in the overall combination.

Accordingly, it will thus be seen from the foregoing description of the invention according to this illustrative embodiment, considered with the accompanying drawings, that the present invention provides new and useful concepts of a novel and advantageous foldable stool device having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

I claim:

1. A foldable seat device, comprising, in combination:

a flexible seat;

a first leg means providing diagonally extending support legs along both sides of the device, and rigidly interconnected by a rear transverse upper support bar, the support legs extending from a rearward upper end to a forward downward end providing a front support leg engagement of the ground;

a second leg means providing diagonally extending supportive upper legs along both sides of the device, and rigidly interconnected by a forward transverse upper support bar, the supportive upper legs extending from a forward upper end to a lower end, there being pivot means, at each side of the device, pivotally connecting the lower end of each respective one of the said supportive upper legs to a generally central portion of the respective support leg of the first leg means;

and the said second leg means also providing diagonally extending supportive lower legs, along both sides of the device, the said supportive lower legs at their lower ends providing rear support leg engagement of the ground;

there being a supportive connection connecting the upper portion of the said supportive lower legs of the said second leg means to the respective support legs of the said first leg means, said supportive connection being at a location spaced from the said pivot means;

the respective supportive upper legs and the supportive lower legs of the second leg means being non-co-linear, and with the second leg means at each side of the device receiving force from the supportive upper legs of the second leg means by transmission of such force through a portion of the first leg means which is between the said pivot means and the said supportive connection.

2. The invention as set forth in claim 1, in a combination in which the supportive connection of the upper ends of the said supportive lower legs to the first leg means is provided by another pivotal connection means, including abutment means limiting the rearward pivotability of the supportive lower legs with respect to the first leg means.

3. The invention as set forth in claim 1, in a combination in which the supportive connection of the upper ends of the said supportive lower legs to the first leg means is provided by connection means movable with respect to the support legs of the first leg means, which provides an option of were, along each support leg of the first leg means, is the connection thereto of the respective supportive lower leg, thereby providing an optional variation in the comparative distance between the lower end of the supportive lower legs of the second leg means to the rear transverse upper bar, and the lower end of the support legs of the first leg means to the forward transverse upper bar, without any change of length of the supportive lower leg of the second leg means.

4. The invention as set forth in claim 2, in a combination in which the supportive connection of the upper ends of the said supportive lower legs to the first leg means is provided by connection means movable with respect to the support legs of the first leg means, which provides an option of where, along each support leg of the of the first leg means, is the connection thereto of the respective supportive lower leg, thereby providing an optional variation in the comparative distance between the lower end of the supportive lower legs of the second leg means to the rear transverse upper bar, and the lower end of the support legs of the first leg means to the forward transverse upper bar, without any change of length of the supportive lower legs of the second leg means.

5. The invention as set forth in claim 3, in a combination in which the movable connection means includes a plurality of detent means, and it also includes a support bracket supportingly interconnecting the respective lower supportive leg and the respective support leg of the first leg means, the detent means including abutment lugs carried by the first leg means, and opening means in the bracket for optionally receiving the abutment lugs.

6. The invention as set forth in claim 4, in a combination in which the movable connection means includes a plurality of detent means, and it also includes a support bracket supportingly interconnecting the respective lower supportive leg and the respective support leg of the first leg means, the detent means including abutment lugs carried by the first leg means, and opening means in the bracket for optionally receiving the abutment lugs.

7. The invention as set forth in claim 5, in a combination in which the bracket carries an ear means, inclined with respect to the first leg means, for pushing the abutment lugs to a retracted position of non-blocking as to the bracket as the bracket is being slid along the first leg means in its movement to optionally engage the abutment lug of a different detent means.

8. The invention as set forth in claim 6, in a combination in which the bracket carries an ear means, inclined with respect to the first leg means, for pushing the abutment lugs to a retracted position of non-blocking as to the bracket as the bracket is being slid along the first leg means in its movement to optionally engage the abutment lug of a different detent means.

9. The invention as set forth in claim 1, in a combination in which the upper ends of the supportive lower legs are supportively connected to the first leg means at a position spaced therealong from the location of the said pivot means.

10. The invention as set forth in claim 2, in a combination in which the supportive upper leg of the second leg means and the supportive lower leg of the second leg means are movable with respect to one another, providing and permitting the supportive upper legs to be positioned to support the forward portion of the seat in seat-providing position with respect to the first leg means even though the supportive rear legs are positioned in non-supportive position.

11. The invention as set forth in claim 1, in a combination in which there is also provided a hook member attached to one of the said components of the device, for providing the carry of the device on the belt of the user; the hook member being downwardly opening, and rigidly connected to the device about midway of the overall length of the first leg means and directly onto the device such as to provide that the device, when hooked to the user's belt, will be held by the hook member to extend significantly both above and below the user's belt.

12. The invention as set forth in claim 2, in a combination in which there is also provided a hook member attached to one of the said components of the device, for providing the carry of the device on the belt of the user; the hook member being downwardly opening, and rigidly connected to the device about midway of the overall length of the first leg means and directly onto the device such as to provide that the device, when hooked to the user's belt, will be held by the hook member to extend significantly both above and below the user's belt.

13. The invention as set forth in claim 3, in a combination in which there is also provided a hook member attached to one of the said components of the device, for providing the carry of the device on the belt of the user; the hook member being downwardly opening, and rigidly connected to the device about midway of the overall length of the first leg means and directly onto the device such as to provide that the device, when hooked to the user's belt, will be held by the hook member to extend significantly both above and below the user's belt.

14. The invention as set forth in claim 4, in a combination in which there is also provided a hook member attached to one of the said components of the device, for providing the carry of the device on the belt of the user; the hook member being downwardly opening, and rigidly connected to the device about midway of the overall length of the first leg means and directly onto the device such as to provide that the device, when hooked to the user's belt, will be held by the hook member to extend significantly both above and below the user's belt.

15. The invention as set forth in claim 9, in a combination in which there is also provided a hook member attached to one of the said components of the device, for providing the carry of the device on the belt of the user; the hook member being downwardly opening, and rigidly connected to the device about midway of the overal length of the first leg means and directly onto the device such as to provide that the device, when hooked to the user's belt, will be held by the hook member to extend signficantly both above and below the user's belt.

* * * * *